US005300083A

United States Patent [19]

Lin et al.

[11] Patent Number: 5,300,083

[45] Date of Patent: Apr. 5, 1994

[54] COMBINED LIGHTER AND CUTTING DEVICE

[76] Inventors: Li-Jan Lin, No. 146, Wen-Hua Rd., Hou-Li Hsiang, Taichung Hsien; Hsien-Yao Chiu, No. 406, Yung-Ho Rd., Chung-Ho City, Taipei Hsien, both of Taiwan

[21] Appl. No.: 64,977

[22] Filed: May 24, 1993

[51] Int. Cl.[5] ..... A61D 1/04

[52] U.S. Cl. ..... 606/165; 606/28; 606/167; 30/140

[58] Field of Search ..... 606/27, 28, 116, 117, 606/163, 164, 165, 167, 174, 175; 607/96, 108; 126/401–404; 30/140; 431/253

[56] References Cited

U.S. PATENT DOCUMENTS

| | | | |
|---|---|---|---|
| 1,399,479 | 12/1921 | Harvey | 606/28 |
| 1,425,671 | 8/1922 | Metzler | 606/28 |
| 1,456,639 | 5/1923 | Lagier | 30/140 |
| 1,584,444 | 5/1926 | Flick | 606/28 |
| 1,763,894 | 6/1930 | Lagier | 606/28 |
| 3,117,578 | 1/1964 | Helbling | 606/28 |
| 3,502,079 | 3/1970 | Simmons et al. | 606/164 |
| 4,046,148 | 9/1977 | Meador | 30/140 |
| 4,587,968 | 5/1986 | Price | 606/28 |

FOREIGN PATENT DOCUMENTS

| | | | |
|---|---|---|---|
| 108317 | 8/1939 | Australia | 606/165 |
| 8800242 | 9/1989 | Netherlands | 606/165 |
| 2075845 | 11/1981 | United Kingdom | 606/165 |

*Primary Examiner*—Ralph Lewis

*Attorney, Agent, or Firm*—Cushman, Darby & Cushman

[57] ABSTRACT

A combined lighter and cutting device includes a fixed handle, a cutting seat, a movable handle, a lighter device and a blade unit. The fixed handle has a pair of arms extending downwardly and frontwardly from one end thereof. The cutting seat is mounted between the distal ends of the arms of the fixed handle. The movable handle is connected pivotally to the fixed handle and has a horizontal support plate that extends forwardly from the hollow member to a space between the two arms of the fixed handle above the cutting seat. The movable handle is moved toward the fixed handle so as to move the support plate toward the cutting seat. The lighter device includes a gas cylinder received in the hollow member and operable so as to release gas from an outlet thereof, a tubular ignition rod communicated with the outlet of the gas cylinder and having a perforated end extending under the support plate, and an ignition device including an ignition electrode secured on the support plate, and a push-button operable so as to generate a spark at the ignition electrode to ignite the gas released by the gas cylinder. The blade unit is connected to the perforated end of the ignition rod under the support plate.

3 Claims, 5 Drawing Sheets

COMBINED LIGHTER AND CUTTING DEVICE

BACKGROUND OF THE INVENTION

1. Field Of The Invention

This invention relates to a combined lighter and cutting device, more particularly to a combined lighter and cutting device which has two cutting modes.

2. Description Of The Related Art

Presently, a tail cutting device is used to cut the tails of piglets so as to prevent the piglets from biting each other's tails when the piglets are fighting for feed. Additionally, an ear cutting device is used to cut the ear of a piglet so as to mark the piglet in order to distinguish which one of the piglets in a herd of piglets has been injected with vaccine. In operation, both the blade of the tail cutting device and the blade of the ear cutting device are heated to a predetermined temperature by a lighter so as to prevent bleeding of the piglet when the tail and/or the ear of the piglet is cut. It is inconvenient and timeconsuming to operate either one of the aforementioned cutting devices and a separate lighter.

SUMMARY OF THE INVENTION

Therefore, the main object of this invention is to provide a combined lighter and cutting device that has two cutting modes.

The second object of this invention is to provide a combined lighter and cutting device that is convenient to operate.

According to this invention, a combined lighter and cutting device includes a fixed handle, a cutting seat, a movable handle, a spring unit, a lighter device and a blade unit. The fixed handle has a pair of arms extending downwardly and frontwardly from one end thereof. The cutting seat is mounted between the distal ends of the arms of the fixed handle. The movable handle has an elongated hollow member with one end connected pivotally to said one end of the fixed handle. The movable handle further has a horizontal support plate that extends forwardly from said one end of the hollow member to the space between the two arms of the fixed handle above the cutting seat and that has a hole formed therein. The movable handle is moved toward the fixed handle so as to move the support plate toward the cutting seat. The spring unit is disposed between the fixed and movable handles so as to bias the movable handle away from the fixed handle. The lighter device includes a gas cylinder received in the hollow member and operable so as to release gas from an outlet thereof, a tubular ignition rod communicated with the outlet of the gas cylinder and having a perforated end extending adjacent to the hole in the support plate under the support plate, and an ignition device including an ignition electrode secured on the support plate and extending along the hole, and a push-button operable so as to generate a spark at the ignition electrode to ignite the gas released by the gas cylinder. The blade unit is connected to the perforated end of the ignition rod under the support plate.

BRIEF DESORIPTION OF THE DRAWINGS

Other features and advantages of the present invention will become apparent in the following detailed description of the preferred embodiment, with reference to the accompanying drawings, of which:

DETAILED DESCRIPTION OF THE PREFERRED EMBODIMENT

Figure 1:
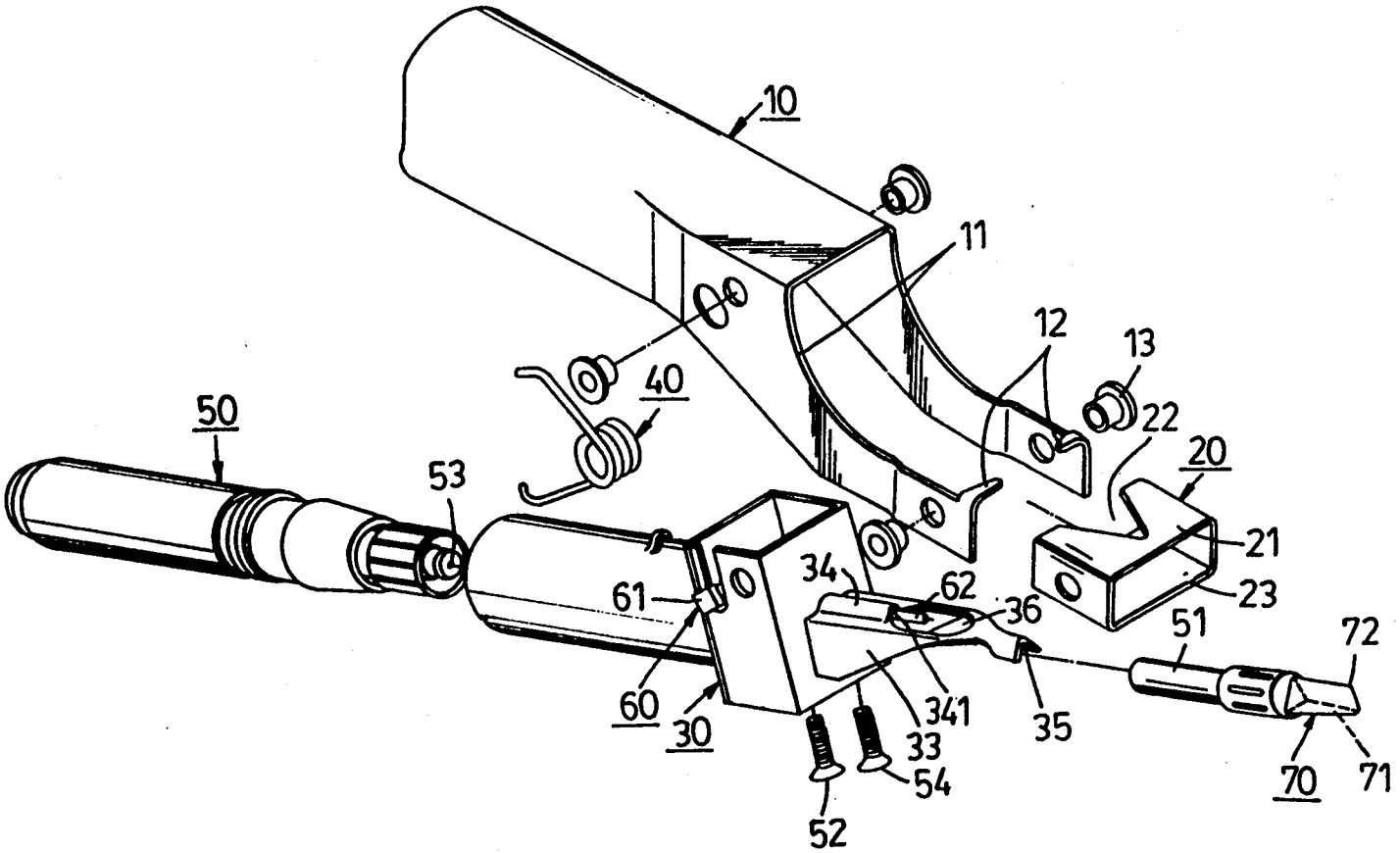
FIG. 1 is an exploded view showing a combined lighter and cutting device according to the present invention.
Figure 2:
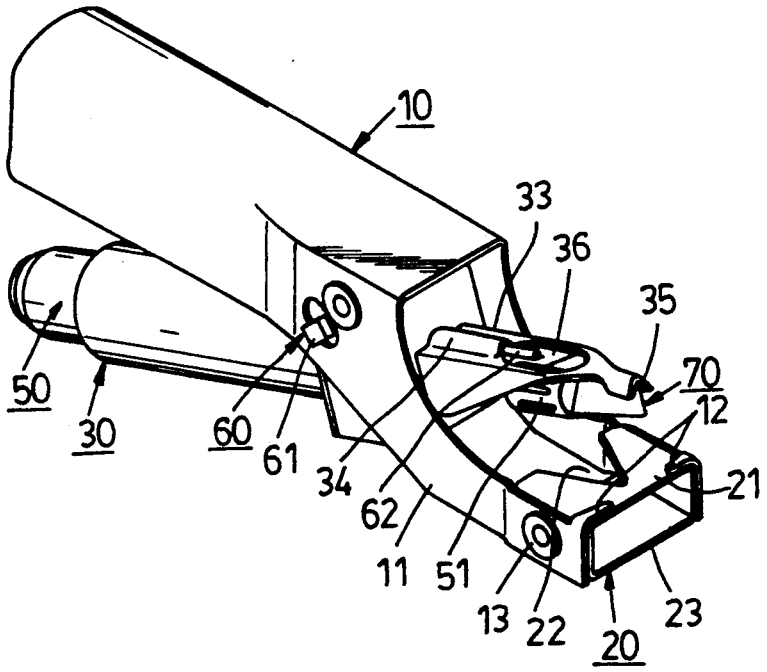
FIG. 2 is a perspective view of the combined lighter and cutting device according to the present invention.

Referring to FIGS. 1 and 2, a combined lighter and cutting device according to this invention includes a fixed handle (10), a cutting seat (20), a movable handle (30), a spring unit (40), a gas cylinder (50), a lighter device (60) and a blade unit (70). The fixed handle (10) has a generally inverted U-shaped configuration and has a pair of arms (11) extending downwardly and frontwardly from one end thereof. The arms (11) confine a space therebetween. Each of the arms (11) has a distal end which is provided with a projection (12) that projects inwardly from an upper edge thereof.

The cutting seat (20) is a hollow rectangular member which is mounted between the distal ends of the arms (11) of the fixed handle (10) by means of rivets (13). The cutting seat (20) has a flat first outer surface (21) with a V-shaped notch (22) formed therein and a flat second outer surface (23) that is opposite to the first outer surface (21). The cutting seat is rotatable relative to the arms between a first position, wherein the first outer surface (21) faces upward and abuts against the projections (12) of the arms, and a second position, wherein the first outer surface (21) faces downward.

Figure 3:
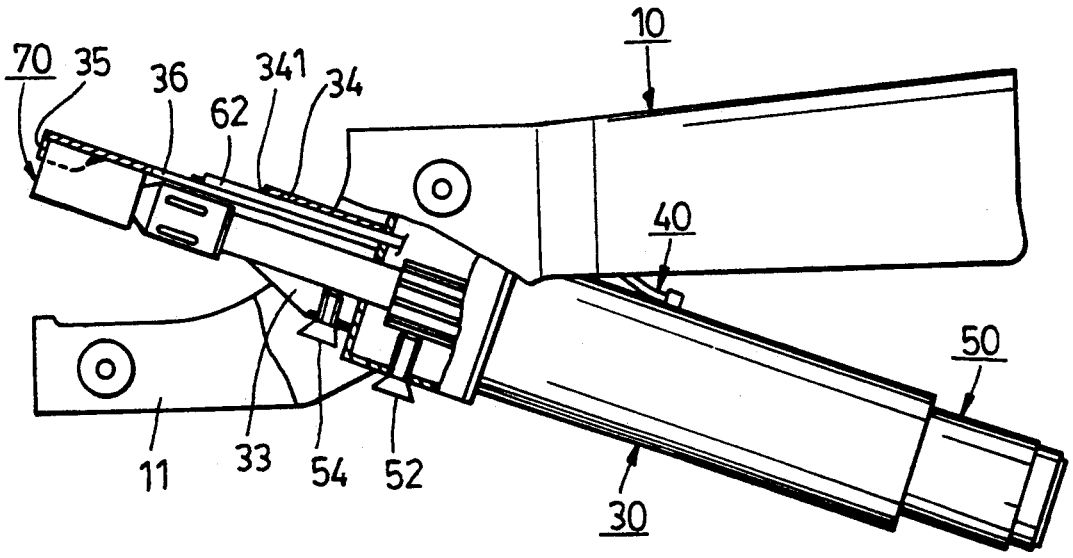
FIG. 3 is a partly sectional side view showing the combined lighter and cutting device according to the present invention.

Referring to FIG. 3 and once more to FIGS. 1 and 2, the movable handle (30) has an elongated hollow member with one end connected pivotally to said one end of the fixed handle (10). The movable handle (30) further has a horizontal support plate (33) extending forwardly from said one end of the hollow member to the space between the two arms (11) of the fixed handle (10) above the cutting seat (20) and has a hole (36) formed therein. A protrusion (34) protrudes upwardly from the support plate (33) between the hole (36) of the support plate (33) and said one end of the hollow member. A bore (341) is formed through the protrusion (34) and is communicated with the hollow member. An inverted V-shaped extension (35) extends frontwardly from a distal end of the support plate (33). The movable handle (30) is moved toward the fixed handle (10) so as to move the support plate (33) toward the cutting seat (20).

The spring unit (40) is a coiled spring and is disposed between the fixed and movable handles (10,30) so as to bias the movable handle (30) away from the fixed handle (10).

The lighter device (60) includes a gas cylinder (50) which is received in an end of the hollow member away from the support plate (33) and which has a body part and a head part extending toward said one end of the hollow member. A positioning bolt (52) extends through a wall of the hollow member and abuts against the head part of the gas cylinder (50) so as to retain the gas cylinder (50) in the hollow member in order to prevent rotation of the head portion relative to the hollow member. The body part of the gas cylinder (50) can be rotated relative to the head part of the gas cylinder (50) so as to be operable in order to release gas from an outlet (53) of the gas cylinder. A tubular ignition rod (51) is communicated with the outlet (53) of the gas cylinder (50) and has a perforated end extending adjacent to the hole (36) in the support plate (33) under the support plate (33). The ignition rod (51) is rotatable relative to an axis of the gas cylinder (50). A locking bolt (54) is provided on the support plate (33) and abuts against a peripheral wall of the ignition rod (51) so as to prevent untimely rotation of the ignition rod (51) relative to the gas cylinder (50). An ignition device is installed in said one end of the hollow member and includes an ignition electrode (62) which extends through the bore (341) in the protrusion (34) and which is secured on the support plate (33) and which extends along the hole (36). The ignition device further includes a push-button (61) which extends out of the hollow member and which is operable so as to generate a spark at the ignition electrode (62) in order to produce a flame at the perforated end of the ignition rod (51) when the gas in the gas cylinder (50) is released and flows to the perforated end of the ignition rod (51).

The blade unit (70) is connected to the perforated end of the ignition rod (51) under the extension (35) of the support plate (33) so that the blade unit (70) is rotated synchronously with the ignition rod (51). The extension (35) serves to protect the blade unit (70). The blade unit (70) has a first cutting surface (71) which conforms with the notch (22) in the first outer surface (21) of the cutting seat (20) and a second cutting surface (72) which has a wedge-shaped cutting edge. The blade unit (70) is rotatable relative to an axis of the gas cylinder (50) between a first cutting position, wherein the cutting seat (20) is in the first position and the first cutting surface (71) faces the first outer surface (21) of the cutting seat (20), and a second cutting position, wherein the cutting seat (20) is in the second position and the second cutting surface (72) faces the flat second outer surface (23) of the cutting seat (20).

Figure 4:
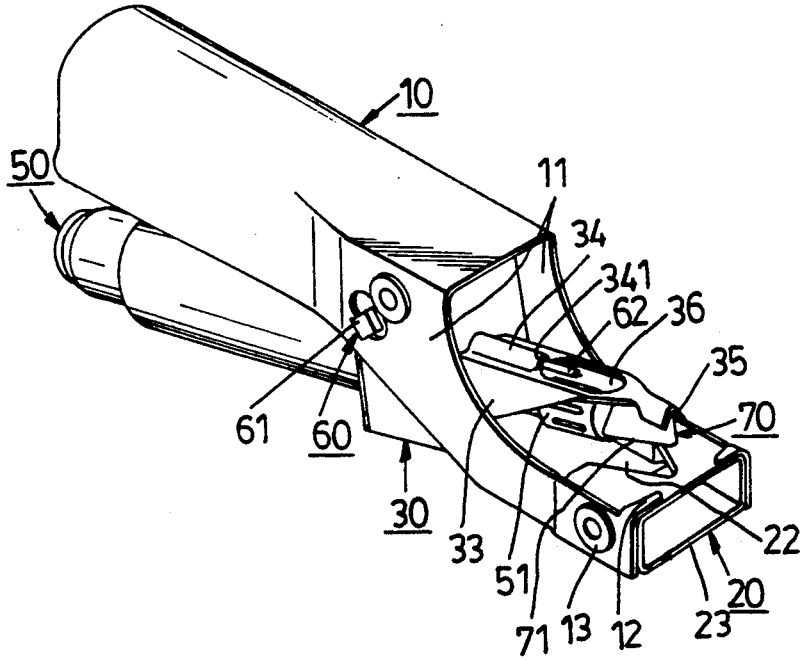
FIG. 4 is a perspective view of the combined lighter and cutting device according to the present invention when the blade unit is in a first cutting position.

In operation, when the combined lighter and cutting device according to the present invention is used as a tail cutting device for cutting the tail of an animal (not shown), such as a piglet, the cutting seat (20) is located in the first position and the blade unit (70) is located in the first cutting position, as illustrated in FIG. 4. The body part of the gas cylinder (50) is rotated relative to the head part of the same so as to release gas from the outlet (53) of the gas cylinder (50) to the perforated end of the ignition rod (51). At the same time, the push-button (61) of the lighter device (60) is operated so that a spark is generated at the ignition electrode (62) in order to ignite the gas released by the gas cylinder (50), thereby heating the blade unit (70) to a predetermined temperature in order to prevent bleeding of the piglet after cutting.

Figure 5:
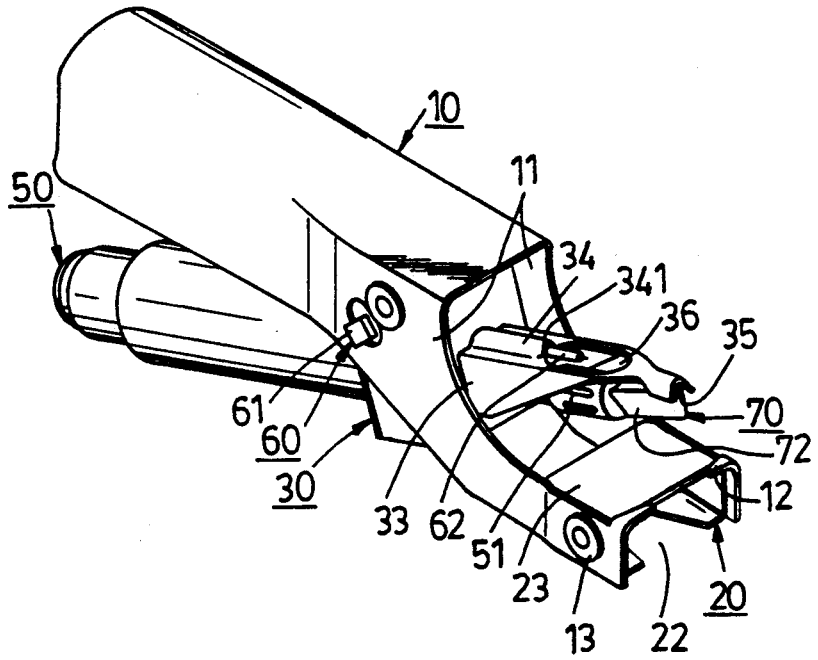
FIG. 5 is a perspective view of the combined lighter and cutting device according to the present invention when the blade unit is in a second cutting position.

Referring to FIG. 5, when the lighter and cutting device according to the present invention is used as to cut the ear of the animal, the cutting seat (20) is rotated from the first position (see FIG. 4) to the second position and the blade unit (70) is rotated from the first cutting position (see FIG. 4) to the second cutting position by operating of the locking bolt (54). At the same time, the gas cylinder (50) and the push-button (61) of the lighter device (60) are operated so as to produce a flame for heating the blade unit (70) to the predetermined temperature.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A combined lighter and cutting device, comprising:

a fixed handle having a pair of arms extending downwardly and frontwardly from one end thereof, said arms confining a space therebetween;

a cutting seat mounted between distal ends of said arms of said fixed handle;

a movable handle having an elongated hollow member with one end connected pivotally to said one end of said fixed handle, said movable handle further having a horizontal support plate extending forwardly from said one end of said hollow member to said space between said two arms of said fixed handle above said cutting seat and having a hole formed therein, said movable handle being moved toward said fixed handle so as to move said support plate toward said cutting seat;

a spring unit disposed between said fixed and movable handles so as to bias said movable handle away from said fixed handle;

a lighter device including a gas cylinder received in said hollow member and operable so as to release gas from an outlet thereof, a tubular ignition rod communicated with said outlet of said gas cylinder and having a perforated end extending adjacent to said hole in said support plate under said support plate, and an ignition device including an ignition electrode secured on said support plate and extending along said hole, and a push-button operable so as to generate a spark at said ignition electrode to ignite said gas released by said gas cylinder; and a blade unit connected to said perforated end of said ignition rod under said support plate.

2. A combined lighter and cutting device as claimed in claim 1, wherein each of said arms has a projection that projects inwardly from an upper edge of said distal end thereof, said cutting seat being a hollow rectangular member which has a first outer surface with a notch formed therein, and a flat second outer surface opposite to said first outer surface, said cutting seat being rotatable relative to said arms between a first position, wherein said first outer surface faces upward and abuts against said projections of said arms, and a second position, wherein said first outer surface faces downward, said blade unit having a first cutting surface which conforms with said notch in said first outer surface of said cutting seat and a second cutting surface, said blade unit being rotatable relative to an axis of said gas cylinder between a first cutting position, wherein said cutting seat is in said first position and said first cutting surface faces said first outer surface of said cutting seat, and a second cutting position, wherein said cutting seat is in said second position and said second cutting surface faces said flat second outer surface of said cutting seat.

3. A combined lighter and cutting device as claimed in claim 1, wherein said horizontal support plate has an inverted V-shaped extension extending frontwardly from a distal end of said support plate.

* * * * *